US006604380B1

(12) United States Patent
Reddick et al.

(10) Patent No.: US 6,604,380 B1
(45) Date of Patent: Aug. 12, 2003

(54) LIQUID NATURAL GAS PROCESSING

(75) Inventors: Kenneth Reddick, Houston, TX (US); Noureddine Belhateche, Houston, TX (US)

(73) Assignee: Howe-Baker Engineers, Ltd., Houston, TX (US)

( * ) Notice: Subject to any disclaimer, the term of this patent is extended or adjusted under 35 U.S.C. 154(b) by 0 days.

(21) Appl. No.: 10/237,847

(22) Filed: Sep. 9, 2002

Related U.S. Application Data

(63) Continuation-in-part of application No. 10/115,150, filed on Apr. 3, 2002.

(51) Int. Cl.[7] ..... F25J 3/00
(52) U.S. Cl. ..... 62/620; 62/617
(58) Field of Search ..... 62/617, 619, 620

(56) References Cited

U.S. PATENT DOCUMENTS

| | | | | |
|---|---|---|---|---|
| 5,114,451 A | | 5/1992 | Rambo et al. | |
| 5,402,645 A | * | 4/1995 | Johnson et al. | 62/619 |
| 5,561,988 A | * | 10/1996 | Mehra | 62/625 |
| 5,588,308 A | | 12/1996 | Daugherty et al. | |
| 5,687,584 A | * | 11/1997 | Mehra | 62/632 |
| 5,953,935 A | | 9/1999 | Sorensen | |

* cited by examiner

*Primary Examiner*—William C. Doerrler
(74) *Attorney, Agent, or Firm*—McDonnell Boehnen Hulbert & Berghoff

(57) ABSTRACT

A process for the recovery of natural gas liquids (NGL) (ethane, ethylene, propane, propylene and heavier hydrocarbons) from liquefied natural gas (LNG) is disclosed. The LNG feed stream is split with at least one portion used as an external reflux, without prior treatment, to improve the separation and recovery of the natural gas liquids (NGL).

14 Claims, 5 Drawing Sheets

LIQUID NATURAL GAS PROCESSING

RELATED APPLICATION

This application is a continuation-in-part of co-pending application U.S. Ser. No. 10/115,150, filed Apr. 3, 2002.

FIELD OF THE INVENTION

The present invention is directed toward the recovery of hydrocarbons heavier than methane from liquefied natural gas (LNG) and in particular to an improved process that uses a portion of the LNG as reflux in the separation process to aid in the recovery of the heavier than methane hydrocarbons.

BACKGROUND OF THE INVENTION

Natural gas typically contains up to 15 vol. % of hydrocarbons heavier than methane. Thus, natural gas is typically separated to provide a pipeline quality gaseous fraction and a less volatile liquid hydrocarbon fraction. These valuable natural gas liquids (NGL) are comprised of ethane, propane, butane, and minor amounts of other heavy hydrocarbons. In some circumstances, as an alternative to transportation in pipelines, natural gas at remote locations is liquefied and transported in special LNG tankers to appropriate LNG handling and storage terminals. The LNG can then be revaporized and used as a gaseous fuel in the same fashion as natural gas. Because the LNG is comprised of at least 80 mole percent methane it is often necessary to separate the methane from the heavier natural gas hydrocarbons to conform to pipeline specifications for heating value. In addition, it is desirable to recover the NGL because its components have a higher value as liquid products, where they are used as petrochemical feedstocks, compared to their value as fuel gas.

NGL is typically recovered from natural gas streams by many well-known processes including "lean oil" adsorption, refrigerated "lean oil" absorption, and condensation at cryogenic temperatures. Although there are many known processes, there is always a compromise between high recovery and process simplicity (i.e., low capital investment). The most common process for recovering NGL from LNG is to pump and vaporize the LNG, and then redirect the resultant gaseous fluid to a typical industry standard turbo-expansion type cyrogenic NGL recovery process. Such a process requires a large pressure drop across the turbo-expander or J.T. valve to generate cryogenic temperatures. In addition, such prior processes typically require that the resultant gaseous fluid, after LPG extraction, be compressed to attain the preexpansion step pressure. Alternatives to this standard process are known and two such processes are disclosed in U.S. Pat. Nos. 5,588,308 and 5,114,451. The NGL recovery process described in the '308 patent uses autorefrigeration and integrated heat exchange instead of external refrigeration or feed turbo-expanders. This process, however, requires that the LNG feed be at ambient temperature and be pretreated to remove water, acid gases and other impurities. The process described in the '457 patent recovers NGL from a LNG feed that has been warmed by heat exchange with a compressed recycle portion of the fractionation overhead. The balance of the overhead, comprised of methane-rich residual gas, is compressed and heated for introduction into pipeline distribution systems.

Our invention provides another alternative NGL recovery process that produces a low-pressure, liquid methane-rich stream that can be directed to the main LNG export pumps where it can be pumped to pipeline pressures and eventually routed to the main LNG vaporizers. Moreover, our invention uses a portion of the LNG feed directly as an external reflux in the separation process to achieve high yields of NGL as described in the specification below and defined in the claims which follow.

SUMMARY OF THE INVENTION

As stated, our invention is directed to an improved process for the recovery of NGL from LNG which avoids the need for dehydration, the removal of acid gases and other impurities. A further advantage of our process is that it significantly reduces the overall energy and fuel requirements because the residue gas compression requirements associated with a typical NGL recovery facility are virtually eliminated. Our process also does not require a large pressure drop across a turbo-expander or J.T. value to generate cryogenic temperatures. This reduces the capital investment to construct our process by 30 to 50% compared to a typical cryogenic NGL recovery facility.

In general, our process recovers hydrocarbons heavier than methane using low pressure liquefied natural gas (for example, directly from an LNG storage system) by using a portion of the LNG feed, without heating or other treatment, as an external reflux during the separation of the methane-rich stream from the heavier hydrocarbon liquids, thus producing high yields of NGL. The methane-rich stream from the separation step is routed to the suction side of a low temperature, low head compressor to re-liquefy the methane rich stream. This re-liquefied LNG is then directed to main LNG export pumps. In alternative flow schemes, as presented below, compression of the methane rich stream is unnecessary when high pressure LNG is used in heat exchange with stabilizer overhead and pumps are used on the recovery bottoms bypassed feed stream.

In an alternate version of our process, the low pressure liquid LNG feed is spilt twice to supply two external reflux streams to two separation columns (for example, a cold separator and a stabilizer). The overhead from each of these towers is combined to form a methane rich stream substantially free of NGL. Possible variations of our process include recovering substantially all of the ethane and heavier hydrocarbons from the LNG, rejecting the ethane while recovering the propane and heavier hydrocarbons, or similarly performing this split of any desired molecular weight hydrocarbon. Also, boil-off vapor can be added to the methane rich stream prior to heat exchange with the incoming low pressure liquid LNG. Boil-off vapor is typically obtained from LNG storage tanks as waste or escaped vapor. In one of the possible variations of our process, ethane recoveries are in the range of about 91 to 95% with 99% propaneplus recovery. In another variation, a typical propane recovery in the ethane rejection mode of operation is from about 94 to about 96% with 99% butane-plus recovery. Similarly, propane could be left in the gaseous stream while recovering 94 to 96% of the butanes.

DETAILED DESCRIPTION OF THE INVENTION

Figure 1:
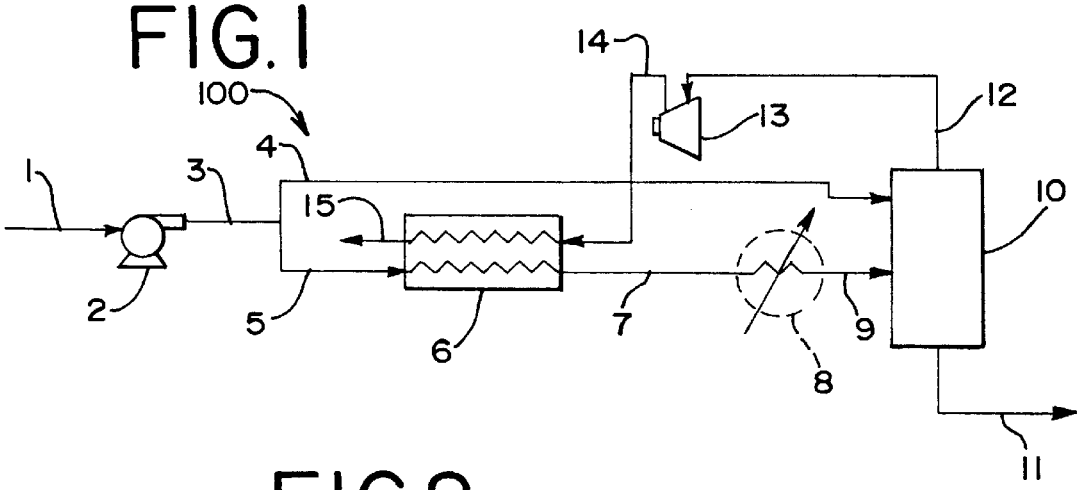
FIG. 1 is a schematic flow diagram of the method of the present invention.

Natural gas liquids (NGL) are recovered from low-pressure liquefied natural gas (LNG) without the need for external refrigeration or feed turboexpanders as used in prior processes. Referring to FIG. 1, process 100 shows the incoming LNG feed stream 1 enters pump 2 at very low pressures, typically in the range of 0–5 psig and at a temperature of less than −200° F. Pump 2 may be any pump design typically used for pumping LNG provided that it is capable of increasing the pressure of the LNG several hundred pounds to approximately 100–500 psig, preferably the process range of 300–350 psig. The resultant stream 3 from pump 2 is physically split into a first portion and a second portion forming streams 4 and 5 respectively, with a first portion (stream 5) preferably being 85–90% of stream 3 and the second portion (stream 4) preferably being 10–15% of stream 3. The split of stream 3 is necessary to the separation process because of the external reflux that stream 4 provides. The preferred relative portions of streams 4 and 5 are beneficial in providing the optimal amount of external reflux (depending on inlet stream composition) in order to maximize NGL recovery while maintaining low capital investment.

The first portion of the LNG feed in stream 5 is warmed by cross-exchange in heat exchanger 6 with substantially NGL-free residue gas in stream 15 exiting the process 100. After being warmed and partially vaporized, the LNG in stream 7 can be further warmed, if needed during process start-up, with an optional heat exchanger 8 (external heat supply) and then fed to separator 10. Separator 10 may be comprised of a single separation process or a series flow arrangement of several unit operations routinely used to separate fractions of LNG feedstocks. The internal configuration of the particular separator(s) used is a matter of routine engineering design and is not critical to our invention. The second portion of LNG feed in stream 4 is bypassed around heat exchangers 6 and 8 and is fed as an external reflux to the top of separator 10. The overhead from separator 10 is removed as methane-rich stream 12 and is substantially free of NGL. The bottoms of separator 10 is removed from process 100 through stream 11 and contains the recovered NGL product. The methane-rich gas overhead in stream 12 is routed to the suction of a low temperature, low head compressor 13. Compressor 13 is needed to provide enough boost in pressure so that stream 14 maintains an adequate temperature difference in the main gas heat exchanger 6 to re-liquefy the methane-rich gas to form stream 15. Compressor 13 is designed to achieve a marginal pressure increase of about 75 to 115 psi, preferably increasing the pressure from about 300 psig to about 350–425 psig. The re-liquefied methane-rich (LNG) in stream 15 is directed to the main LNG export pumps (not shown) where the liquid will be pumped to pipeline pressures and eventually routed to the main LNG vaporizers. Process 100 can also be operated in an "ethane rejection mode." The flow schematic for this mode is substantially similar to FIG. 1. The main difference in this mode of operation is that it is desirable to drive the majority of the ethane contained in feed stream 1 overhead in separator 10 so that stream 15 is comprised of mainly methane and ethane and the recovered NGL product stream 11 is comprised of propane and heavier hydrocarbons. Operation of this mode is typically accomplished by addition preheating of stream 9 and/or additional heating to the bottom of separator 10.

Figure 2:
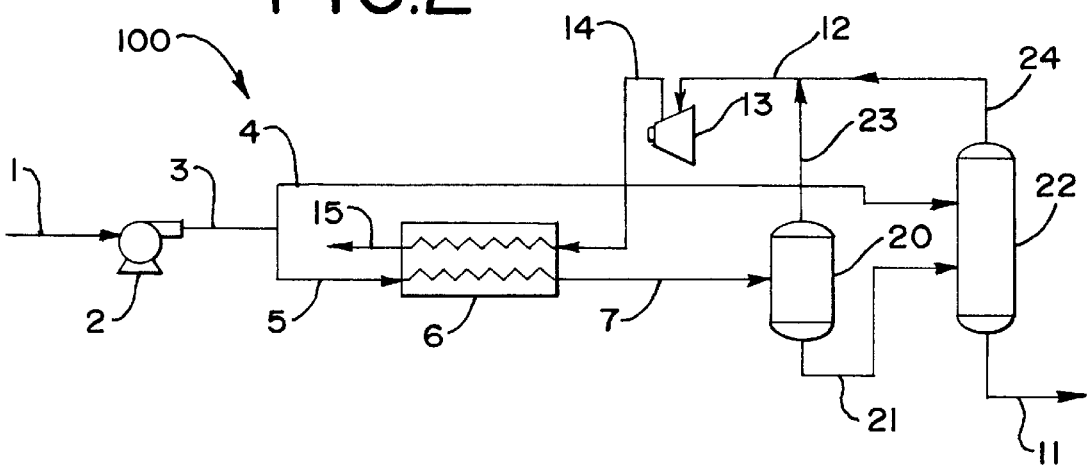
FIG. 2 is a schematic flow diagram of another method of the present invention.

FIG. 2 shows an alternate embodiment of our invention where stream 7 first undergoes separation in cold separator 20. Equivalent stream and equipment reference numbers are used to indicate identical equipment and stream compositions to those described previously in reference to FIG. 1. An NGL rich bottom stream 21 is removed from Separator 20 and eventually routed to a second separation process, such as stabilizer 22. A methane-rich overhead stream 23 is removed from cold separator 20 and eventually combined with methane-rich overhead stream 24 removed from stabilizer 22. A recovered NGL product stream 11 is removed from stabilizer 22 and routed to NGL storage or pumped to an NGL pipeline or fractionator (not shown). As with the embodiment shown in FIG. 1, incoming LNG feed 1 is separated after pump 2 to produce a slip stream 4 containing untreated LNG. Stream 4 is used as an external reflux in stabilizer 22 to assist in the separation of the methane-rich components from the NGL products, which are eventually removed via stream 11. Stream 4 works extremely well as a reflux because it is very cold (typically around −250° F.) and because it is very lean. Stream 4 is mostly comprised of methane; thus, it is very effective in removing heavier hydrocarbon compounds from the overhead of stabilizer 22.

Figure 3:
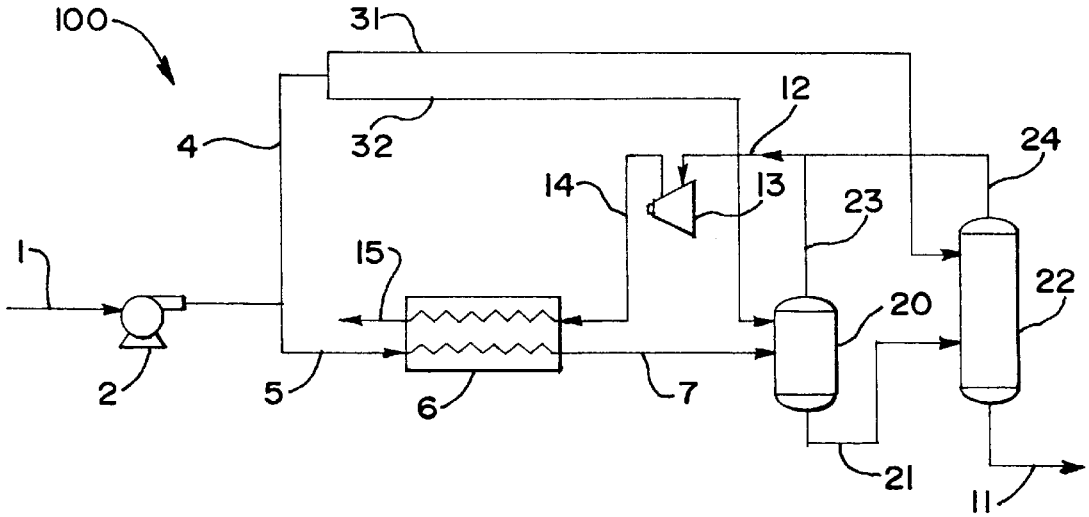
FIG. 3 is a schematic flow diagram of yet another method of the present invention.

Yet another embodiment of our invention is shown in FIG. 3, where, like the process of FIG. 2, two or more separators (cold separator 20 and stabilizer 22) are used in series to achieve ethane recoveries of 91 to 95% and 99+% propane recover. In this case, the LNG feed is split twice, first to create stream 5 that is used in heat exchange with compressed methane-rich stream 14 and also to create stream 4 comprising untreated LNG feed. Stream 4 is then split into streams 31 and 32, which are used as external reflux for stabilizer 22 and cold separator 20, respectively.

Figure 4:
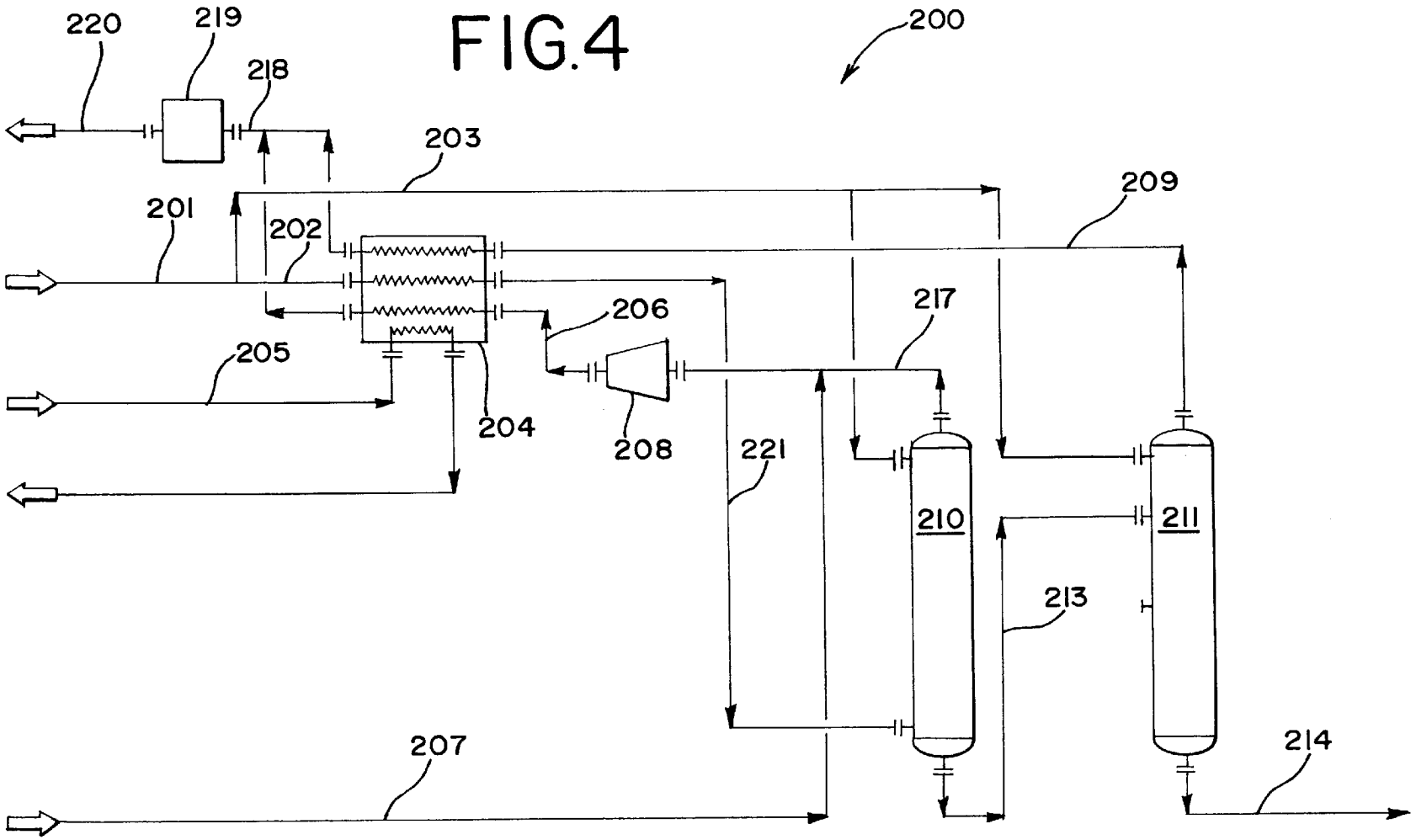
FIG. 4 is a schematic flow diagram of an alternative embodiment of the present invention.

Referring now to FIG. 4, process 200 recovers NGL from a feed of low-pressure LNG 201, which enters process 200 via a pump (not shown) and is split into two streams 202 and 203, respectively. Stream 202 is heat exchanged in cold box 204 with several process streams, including high pressure LNG obtained from the LNG storage facility, a combination of compressed boil-off vapor and recovery tower overhead in stream 206 and stabilizer overhead 209. Stream 203, containing a portion of the incoming low pressure LNG and without heat exchange or other process treatment, is used as reflux for recovery tower 210 and stabilizer 211. The other portion of feed 201, after exchange in cold box 204, is stream 221 which is fed to recovery tower 210 where a methane-rich stream 217 is removed as recovery tower overhead and is optionally combined with boil-off vapor 207, compressed in compressor 208, fed to cold box 204 and eventually removed from process 200 after mixing with heat exchanged stabilizer overhead 209 in mixer 219. Stream 221 can have an optional start-up hear exchanger (not shown) to further increase the temperature of the LNG after heat exchange in cold box 204.

The bottom of recovery tower 210 is removed as stream 213 and fed to stabilizer 211 where bottoms 214 are removed as an NGL product. The NGL product may be sent to fractionation, pipeline or storage.

Figure 5:
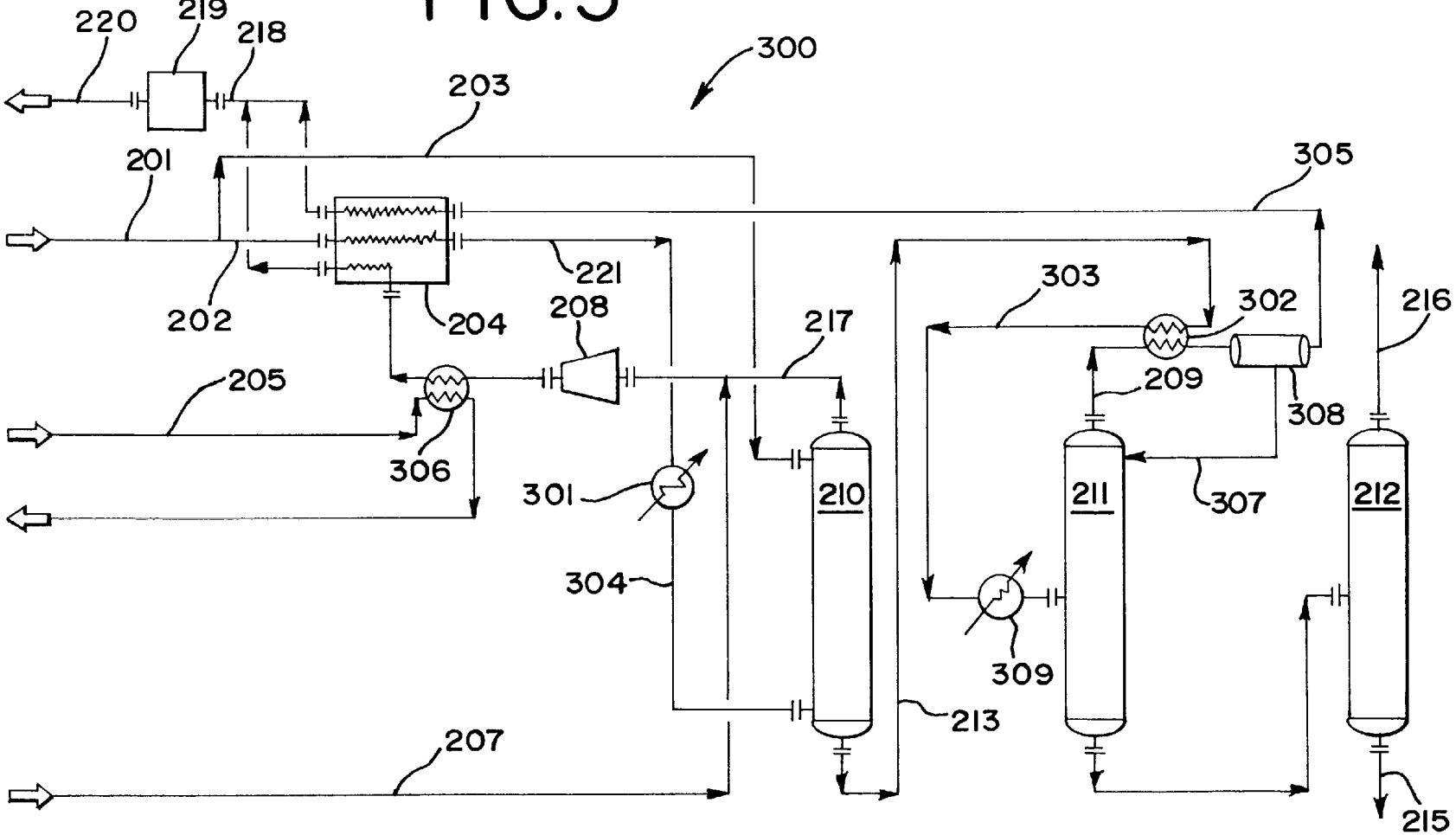
FIG. 5 is a schematic flow diagram of an alternative embodiment of the present invention.

FIG. 5 shows another alternative process flow scheme of our invention. Where process streams and equipment are equivalent to those shown in FIG. 4. The process embodiment in FIG. 5 uses a pre-chiller 306 to heat exchange the high pressure LNG in stream 205 with the compressed boil-off vapor 207 and recovery tower overhead 217 prior to heat exchange with a portion of the low-pressure LNG feed 202 in cold-box 204. In similar fashion, stabilizer overhead 209 is heat exchanged with recovery tower bottoms 213 using exchanger 302 prior to heat exchange in cold box 204. The use of exchanger 302 avoids the need to split feed stream 203 into two separate reflux streams and instead uses reflux accumulator 308 to produce reflux stream 307. Feed 221 is also pre-heated using exchanger 301 prior to being fed to recovery tower 210. Likewise, heat exchanged recover tower bottoms 303 is heated using heat exchangers 309 prior to being fed to stabilizer 211.

Figure 6:
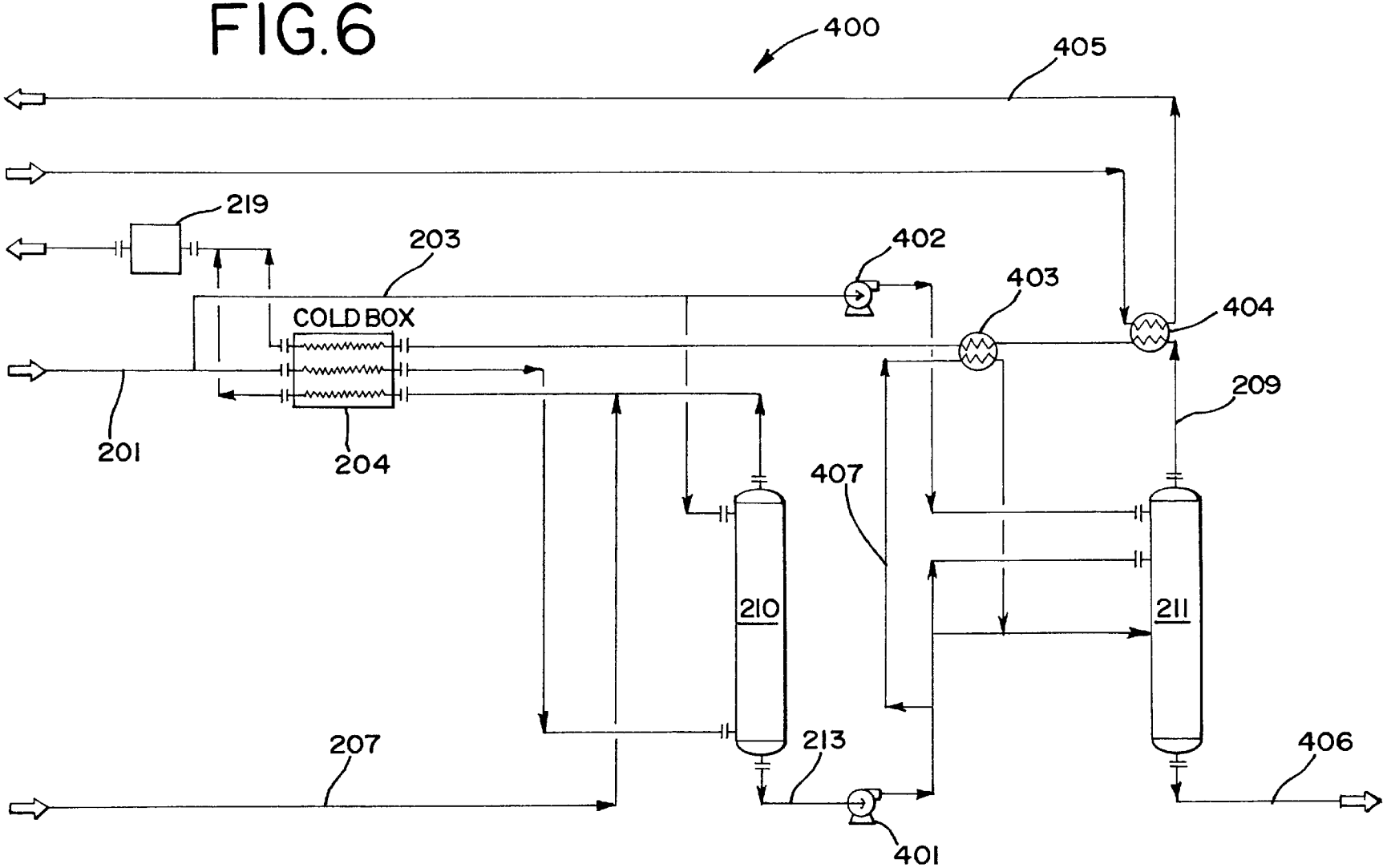
FIG. 6 is a schematic flow diagram of an alternative embodiment of the present invention.
Figure 7:
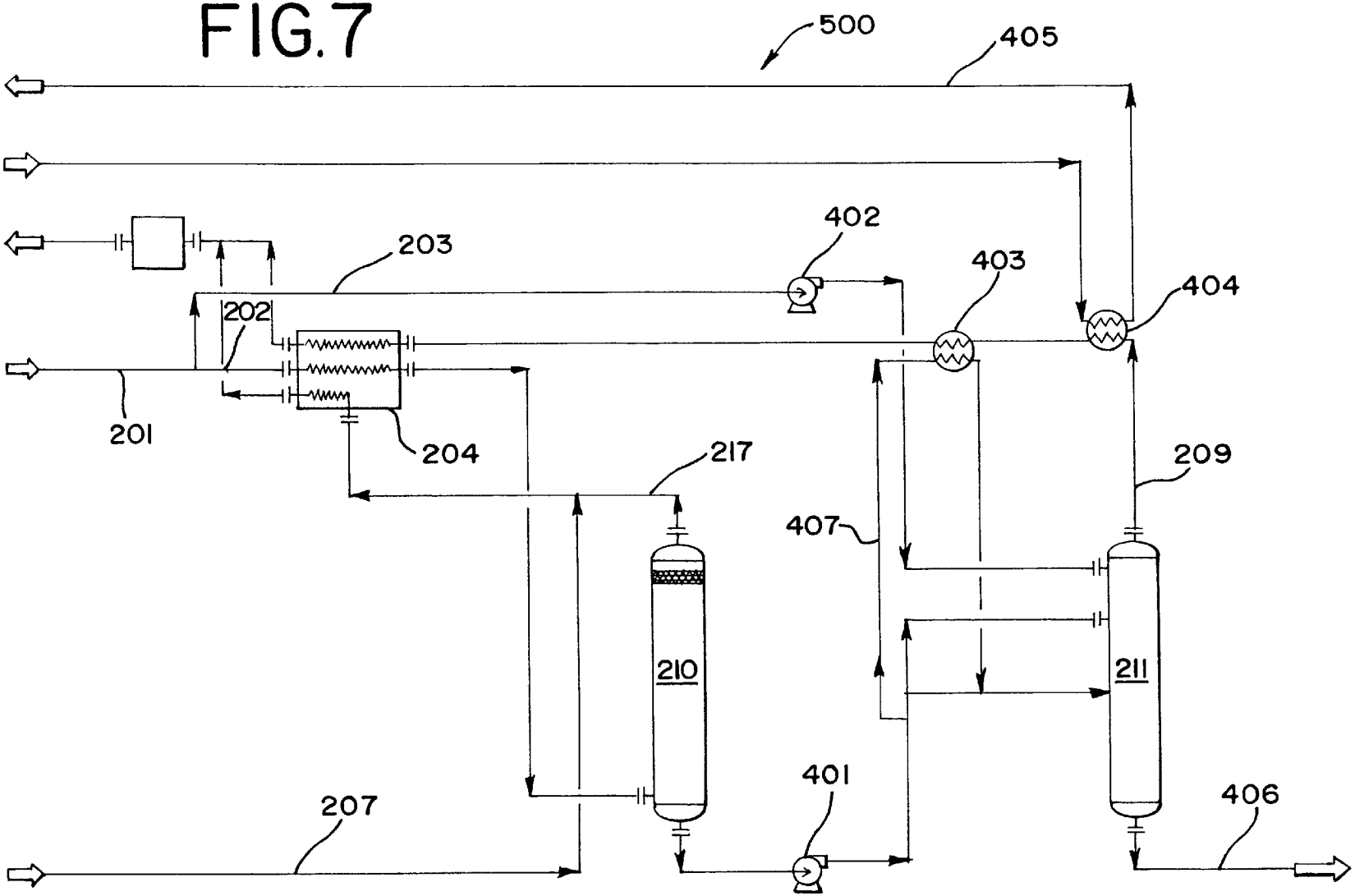
FIG. 7 is a schematic flow diagram of an alternative embodiment of the present invention.

Turning now to FIGS. 6 and 7, two other embodiments of our invention are illustrated as processes 400 and 500, respectively. Again, where the equipment and streams are equivalent to what is illustrated in FIG. 4, the reference numerals are the same. Each of these alternative embodiments are characterized in that the cryogenic compressor used to compress the recovery tower overhead is eliminated. This is possible because of a combination of feed pumps 401 and 402, and heat exchanger 404 which provides heat from high pressure LNG 405. In FIG. 7, feed stream 203, which is bypassed around cold box 204 is not split as it is in FIG. 6 and instead is directed via pump 402 directly to stabilizer 211 as reflux. Recovery tower 210 bottoms is directed via pump 401 to stabilizer 211. A portion of the recovery bottoms 407 is directed to exchanger 403 where it is heat exchanged with stabilizer overhead 209 subsequent to being heat exchanged with the high pressure LNG 405. Stabilizer bottoms 406 comprises the NGL product.

As one knowledgeable in this area of technology, the particular design of the heat exchangers, pumps, compressors and separators is not critical to our invention. Indeed, it is a matter of routine engineering practice to select and size the specific unit operations to achieve the desired performance. Our invention lies with the unique combination of unit operations and the discovery of using untreated LNG as external reflux to achieve high levels of separation efficiency in order to recover NGL.

While we have described what we believe are the preferred embodiments of the invention, those knowledgeable in this area of technology will recognize that other and further modifications may be made thereto, e.g., to adapt the invention to various conditions, type of feeds, or other requirements, without departing from the spirit of our invention as defined by the following claims.

We claim:

1. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box and splitting the second portion of pressurized liquid LNG from step b) into a first reflux and a second reflux;

e) directing the heat exchanged first portion of pressurized liquid LNG from step c) to a recovery tower where in combination with the first reflux without heat exchange generates a recovery tower overhead and a stabilizer feed;

f) directing the stabilizer feed to a stabilizer where in combination with the second reflux without heat exchange generates a stabilizer overhead and NGL stream;

g) compressing the recovery tower overhead to form a methane rich stream;

h) directing the methane rich stream and the stabilizer overhead to the cold box where they are heat exchanged with the first portion of pressurized liquid LNG; and i) mixing the heat exchanged methane rich stream and stabilizer overhead.

2. The process of claim 1 where boil-off vapor is combined with the recovery tower overhead prior to compression to form the methane rich stream.

3. The process of claim 1 further characterized in that the methane rich stream heat exchanged with high pressure LNG prior to entering cold box.

4. The process of claim 1 further characterized in that high pressure LNG is directed to the cold box for heat exchange with the first portion of pressurized liquid LNG.

5. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box and splitting the second portion of pressurized liquid LNG from step b) into a first reflux and a second reflux;

e) directing the heat exchanged first portion of pressurized liquid LNG from step c) to a recovery tower where in combination with the first reflux without heat exchange generates a recovery tower overhead and a stabilizer feed;

f) directing the stabilizer feed to a stabilizer where in combination with the second reflux without heat exchange generates a stabilizer overhead and NGL stream;

g) directing the recovery tower overhead and the stabilizer overhead to the cold box where they are heat exchanged with the first portion of pressurized liquid LNG;

h) compressing the heat exchanged recovery tower overhead; and i) mixing the heat exchanged stabilizer overhead and compressed heat exchanged recovery tower overhead.

6. The process of claim 5 further characterized in that a boil-off vapor is directed to the cold box for heat exchange with the first portion of pressurized liquid LNG.

7. The process of claim 5 further characterized in that high pressure LNG is directed to the cold box for heat exchange with the first portion of pressurized liquid LNG.

8. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box with the second portion of pressurized liquid LNG and using it as an external reflux in a recovery tower, where in combination with the heat exchanged first portion of pressurized LNG from step c) generates a recovery tower overhead and a stabilizer feed;

e) directing the stabilizer feed to a stabilizer to generate a stabilizer overhead and a NGL stream;

f) compressing the recovery tower overhead to form a methane rich stream;

g) directing the methane rich stream and the stabilizer overhead to the cold box where they are heat exchanged with the first portion of pressurized liquid LNG; and h) mixing the heat exchanged methane rich stream and stabilizer overhead.

9. The process of claim 8 where boil-off vapor is combined with the recovery tower overhead prior to compression to form the methane rich stream.

10. The process of claim 8 further in that the stabilizer overhead is heat exchanged with the stabilizer feed.

11. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box with the second portion of pressurized liquid LNG from step b) and increasing the pressure of the second portion to form a stabilizer reflux;

e) directing the heat exchanged first portion of pressurized liquid LNG from step c) to a separator to generate a separator overhead stream and a stabilizer feed;

f) directing a first portion of the stabilizer feed to a stabilizer;

g) heat exchanging a second portion of the stabilizer feed with a stabilizer overhead and feeding the heat exchanged second portion of stabilizer feed to the stabilizer where in combination with the reflux generates the stabilizer overhead and a NGL stream;

h) heat exchanging the stabilizer overhead with high pressure LNG prior to heat exchanging with the second portion of stabilizer feed;

j) directing the separator overhead stream and the twice heat exchanged stabilizer overhead to the cold box where they are heat exchanged with the first portion of pressurized liquid LNG; and i) mixing the heat exchanged separator overhead stream and the stabilizer overhead.

12. The process of claim 11 wherein boil-off vapor is combined with the separator overhead stream prior to introduction of the separator overhead into the cold box.

13. A process of recovering hydrocarbons heavier than methane from liquefied natural gas (LNG) comprising, a) pumping liquid, low pressure LNG to a pressure of greater than 100 psia;

b) splitting the pressurized liquid LNG from step a) into first and second portions;

c) directing the first portion of pressurized liquid LNG from step b) to a cold box where it is heat exchanged to increase its temperature;

d) bypassing the cold box and splitting the second portion of pressurized liquid LNG from step b) into a first reflux and a second reflux;

e) increasing the pressure of the second reflux prior to directing it to a stabilizer;

f) directing the heat exchanged first portion of pressurized liquid LNG from step c) to a recovery tower to generate a recovery tower overhead and a stabilizer feed;

g) directing a first portion of the stabilizer feed to the stabilizer;

h) heat exchanging a second portion of the stabilizer feed with a stabilizer overhead and feeding the heat exchanged second portion of stabilizer feed to the stabilizer where in combination with the second reflux generates the stabilizer overhead and an NGL stream;

i) heat exchanging the stabilizer overhead with high pressure LNG prior to heat exchanging with the second portion of stabilizer feed;

j) directing the recovery tower overhead and the twice heat exchanged stabilizer overhead to the cold box where they are heat exchanged with the first portion of pressurized liquid LNG; and k) mixing the heat exchanged recovery tower overhead and stabilizer overhead.

14. The process of claim 13 wherein boil-off vapor is combined with the recovery tower overhead prior to the introduction of the recovery tower overhead into the cols box.

* * * * *